US006795980B1

(12) United States Patent
Ries

(10) Patent No.: US 6,795,980 B1
(45) Date of Patent: Sep. 28, 2004

(54) TOILET BOWL ODOR REMOVAL SYSTEM

(76) Inventor: Edward F. Ries, 450 Porter La., San Jose, CA (US) 95127

( * ) Notice: Subject to any disclaimer, the term of this patent is extended or adjusted under 35 U.S.C. 154(b) by 0 days.

(21) Appl. No.: 10/752,056

(22) Filed: Jan. 6, 2004

(51) Int. Cl.[7] ..... A47K 13/00
(52) U.S. Cl. ..... 4/217
(58) Field of Search ..... 4/209 R, 213, 4/216, 217

(56) References Cited

U.S. PATENT DOCUMENTS

| | | | | | |
|---|---|---|---|---|---|
| 1,122,264 | A | | 12/1914 | Douglas | |
| 3,386,109 | A | | 6/1968 | Christian et al. | 4/213 |
| 3,491,382 | A | | 1/1970 | Poister | 4/217 |
| 3,649,972 | A | | 3/1972 | Sowards | 4/211 |
| 3,659,296 | A | | 5/1972 | Stamper | 4/217 |
| 3,689,944 | A | * | 9/1972 | Clayton et al. | 4/213 |
| 3,733,619 | A | | 5/1973 | Smith | 4/72 |
| 3,740,772 | A | | 6/1973 | Paley | 4/217 |
| 3,916,459 | A | | 11/1975 | Ivancevic | 4/213 |
| 3,953,901 | A | | 5/1976 | Poister et al. | 4/213 |
| 3,999,225 | A | | 12/1976 | Ables | 4/213 |
| 4,174,545 | A | | 11/1979 | Smith, Jr. | 4/217 |
| 4,251,888 | A | | 2/1981 | Turner | 4/213 |
| 4,344,194 | A | * | 8/1982 | Pearson | 4/213 |
| 4,586,201 | A | | 5/1986 | Todd, Jr. | 4/217 |
| 4,617,687 | A | | 10/1986 | Wadsworth | 4/213 |
| 4,853,981 | A | | 8/1989 | Hunnicutt, Jr. | 4/213 |
| 5,079,783 | A | | 1/1992 | Haletsky et al. | 4/217 |
| 5,257,421 | A | | 11/1993 | Rose et al. | 4/214 |
| 5,355,536 | A | | 10/1994 | Prisco | 4/217 |
| 5,539,937 | A | * | 7/1996 | Barefoot | 4/213 |
| 5,555,572 | A | | 9/1996 | Hunnicutt, Jr. | 4/213 |
| 5,896,591 | A | | 4/1999 | Horan et al. | 4/213 |
| 6,052,837 | A | | 4/2000 | Norton et al. | 4/217 |
| 6,546,567 | B2 | | 4/2003 | Nuzniar | 4/217 |

* cited by examiner

*Primary Examiner*—Gregory L. Huson
*Assistant Examiner*—Huyen Le
(74) *Attorney, Agent, or Firm*—Thomas Schneck; David M. Schneck

(57) ABSTRACT

A toilet ventilation system including a fan housed within an interior space in a toilet seat lid, an intake passage created when the seat is down and the lid is raised, a stationary outflow duct through which evacuated air is driven, and a switch for activation of the fan. The system removes air from the toilet bowl, and vents it to a remote location.

11 Claims, 6 Drawing Sheets

TOILET BOWL ODOR REMOVAL SYSTEM

TECHNICAL FIELD

The invention relates to an odor removal system and more particularly to an odor removal system for toilet bowls.

BACKGROUND ART

The prior art includes a multitude of methods for removing odors from toilet bowls. A common approach can be seen in U.S. Pat. No. 6,550,072 to Ware in 2003. This approach includes an air intake at the toilet bowl, which is ducted to an exhaust fan installed away from the toilet. Another example of this approach can be found in U.S. Pat. No. 1,122,264 to Douglas in 1914. Although this approach is effective in removing odors, it has not received widespread commercial acceptance in 90 years. This could be due to the draw-backs of using an external fan. To install the fan in the room adjacent to the toilet is unsightly. Building the fan into the wall behind the toilet is problematic due to the plumbing pipes typically found in this location. Mounting the fan remotely in an attic or on the roof makes service more difficult and the installation more expensive.

Another approach is typified by U.S. Pat. No. 4,103,370 by Arnold. In this approach, the fan is located inside the toilet tank, and the air is exhausted to the sewer line. Although this approach is aesthetically pleasing it has disadvantages. This approach involves a redesign of the entire toilet. To install this toilet ventilation system would require the replacement of the entire toilet. Also there is a code problem with connecting the exhaust to the sewer line. Commonly, plumbing codes do not allow a connection to a sewer line unless protected by a water trap. It is not feasible to add a water trap to the exhaust duct in this concept.

U.S. Pat. No. 4,344,194 by Pearson and U.S. Pat. No. 4,853,981 by Hunnicutt have found the ideal location for the fan—in the toilet lid. To install a toilet ventilation system without replacing the entire toilet generally means that the toilet seat assembly be replaced. The toilet seat assembly typically incorporates the intake means, as well as the switching means. With the fan than in the seat assembly, the fan is installed when the seat assembly is replaced. The fan is readily accessible for service in this location.

If one considers the characteristics of the ideal toilet exhaust fan, the advantages of the lid location become more apparent. The ideal fan for toilet bowl ventilation produces relatively low airflow volume at relatively high pressure. Approximately 10 cubic feet per minute (cfm) of air volume is needed at 0.3 inch water column of pressure. A centrifugal blower is needed to achieve these flow characteristics at low noise levels. For centrifugal blowers, the diameter of the blower wheel contributes to pressure, and the width that contributes to volume. Thus the ideal blower wheel is relatively large in diameter, but small in width. A fan wheel of such proportions is well suited to fit inside the toilet lid when the wheel is oriented in the same plane as the lid.

U.S. Pat. No. 4,344,194 by Pearson and U.S. Pat. No. 4,853,981 by Hunnicutt have charcoal filters built into the lid in addition to the fans. Charcoal filters are intended to remove the odor so the air can be discharged back into the room, thereby avoiding ducting the exhaust to the exterior. Although this approach simplifies installation and improves aesthetics, it is less successful in achieving the basic goal of the ventilation system—to remove the odors. Charcoal filters of the size that will fit in a toilet lid are less than 100% efficient at removing odors. Since the human nose is very sensitive to the odors in question the perceived performance of the charcoal filter approach is disappointing.

It is an object of the present invention to disclose an alternative venting toilet seat in which the fan is included in the toilet seat lid and connected to exhaust ducts. The air collected from the toilet bowl is driven by the fan into ducts which transport the collected air to a location remote from the toilet.

SUMMARY OF THE INVENTION

The present invention is a device for the removal of toilet bowl odors including a toilet seat lid having interior space. A fan is contained within the interior space and is in communication with an intake duct in the lid. When the lid is raised, the intake duct joins with an air passage formed by the mounting blocks to create a continuous air passage from the toilet bowl to the fan. This allows the fan to draw air from the toilet bowl. The fan discharges the air into one or more outflow ducts which extend from the side of the toilet lid. The device also includes a fan activation switch which is actuated by raising the toilet seat lid when the seat is down.

The outflow ducts may extend through a building wall and vent the air to outside a building. The outflow ducts may also be connected to an odor neutralization device located in the proximity of the toilet such as a charcoal filter system. The ducts may also be linked into a network of outflow ducts in a commercial building or other establishment having multiple toilets in close proximity.

DETAILED DESCRIPTION OF THE INVENTION

The present invention is toilet seat assembly that removes odors from the toilet bowl and discharges the evacuated air into exhaust ducts. By removing odor at the source odor does not reach the toilet user's nose.

A typical seat assembly consists of a seat, lid, hinge, and associated hardware to attach the toilet seat and lid assembly to the porcelain toilet bowl. The present invention includes the same elements and could be rather easily retrofitted onto an existing porcelain toilet bowl without requiring removal of the entire toilet including toilet bowl and toilet tank.

In previous disclosures utilizing a fan in the lid, a filter has been used to neutralize the odor. These filters have been installed in the lid of the seat at the inlet to the fan. Such filters do not completely remove the odor. The present invention uses discharge tubes which can be extended to the exterior, or connected to a filter when discharging to the exterior is not feasible. By making the filter remote from the seat assembly its size is not limited by the size of the toilet lid. A convenient spot to locate such a remote filter is between the base of the toilet and the back wall.

In previous disclosures using a fan in the lid, the air discharge port moved and rotated as the lid was raised or lowered. This design is not suitable for the connection of stationary exhaust ducts. The discharge ports must themselves be stationary. To accomplish this, hollow hinge pins serve as the discharge tubes. The seat and lid are hinged about the discharge tube.

The use of discharge tubes significantly alters the configuration of the seat assembly compared to the previous art utilizing a fan in the lid. The intake duct, fan housing and discharge port must all be configured differently. A practical requirement of all toilet seat assemblies is that the seat and lid must remain in the raised position by gravity. Meeting this requirement with the altered configuration of the fan housing and ducts meant the hinge configuration and mounting blocks must also be significantly altered compared to prior disclosed configurations.

The appearance of the discharge tubes may be important to some users. Flexible hoses are unsightly and must be kept out of view. In an embodiment of the present invention, the aesthetics are enhanced by extending the seat assembly discharge tubes far enough below the toilet tank that the exhaust hose connection is hidden by the tank. The discharge tubes would have a bright chrome finish as is typical for exposed plumbing fixtures. A flush valve on a commercial toilet is an example of an exposed plumbing fixture with a bright chrome finish. The discharge tubes would have a commercial look similar to a flush valve.

Figure 1:
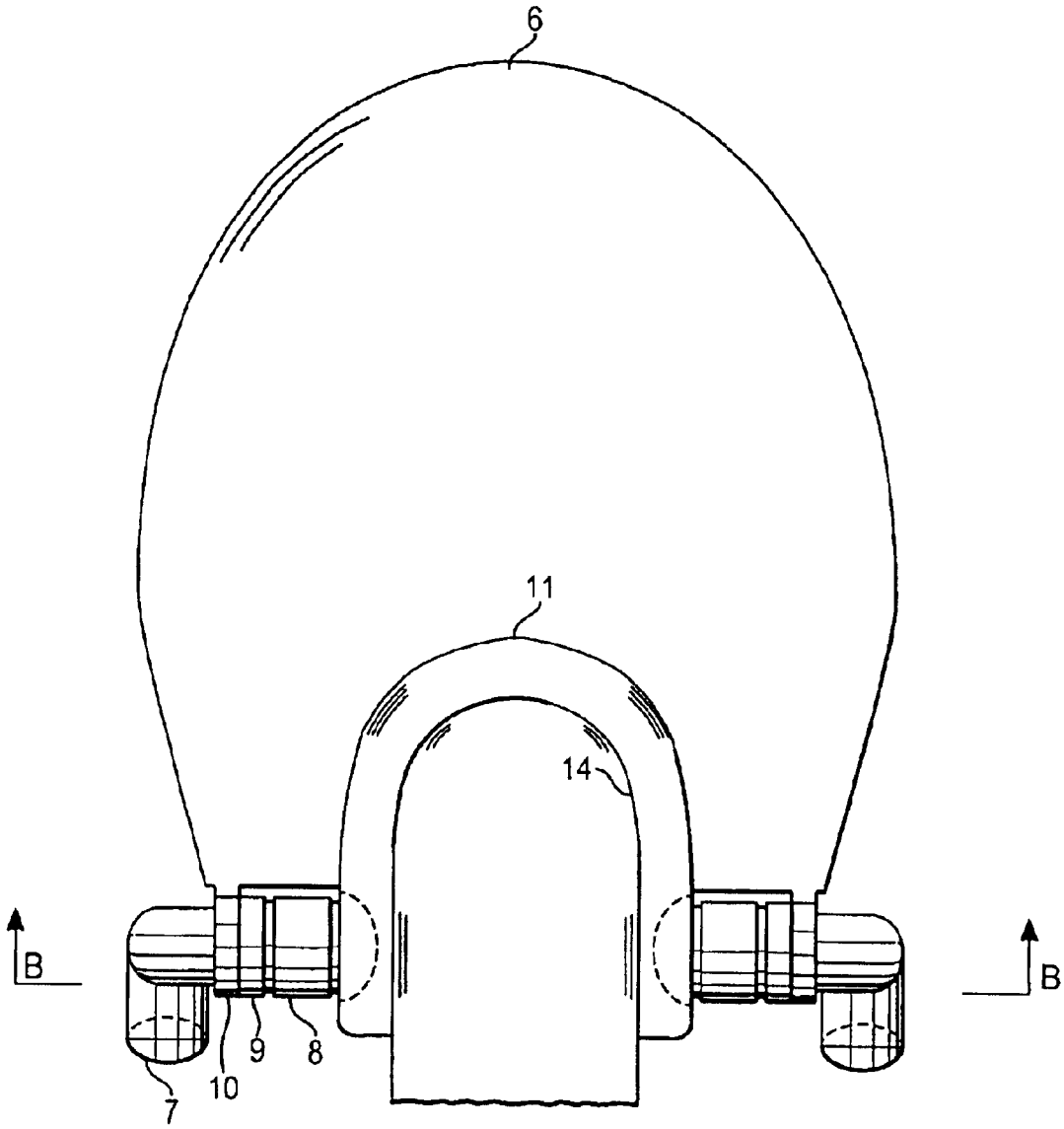
FIG. 1 is a top view of the toilet lid of the present invention.

With respect to FIG. 1, the present invention includes toilet bowl lid 6. At the rear of toilet lid 6 is a blower housing 11 integral with lid 6. A blower intake duct 14 is also an integral part of lid 6 mounted over a central area of blower housing 11.

In an alternative embodiment the intake duct 14 is removable from the fan housing. A removable intake would be accessible for cleaning. Cleaning of the intake duct may be needed periodically. Additionally, the removable intake may provide a convenient way to access batteries in the version where batteries are used. Also, a removable intake duct may enhance safety. If fingers were present in the intake passage when the lid is raised, the intake would pinch the fingers. An intake duct which may snap on and off eliminates these problems and could be removed during cleaning. It could be held in place with clips or some device that allows it to snap on and off easily. Adjacent to the sides of blower housing 11 is mounting block 8. Mounting block 8 includes a bore for the mounting screw for attaching the device to the toilet tank. The mounting block also includes a bore for the venting ducts. The bore may include a clamping device for creating a tight fit around the discharge tube. Seat hinge 9 may be mounted on the discharge tube to allow raising and lowering of the toilet seat. Lid hinge 10 may also be mounted on the discharge tube. Discharge tube 7 extends through mounting block 8.

Figure 2:
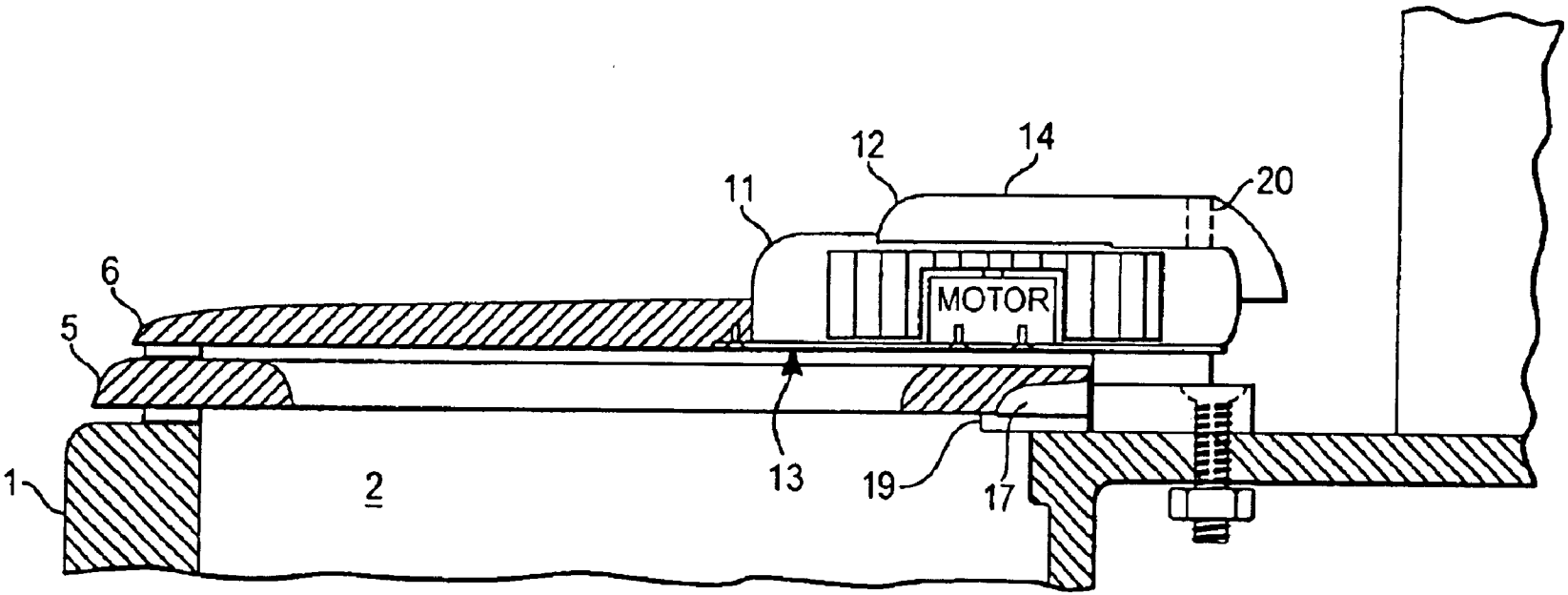
FIG. 2 is a cross section of the lid of FIG. 1 with a cross sectional view of a toilet seat and toilet bowl.

The cross-section taken along arrow A is illustrated in FIG. 2. Toilet 1 is shown having toilet bowl 2. Mounted over the rim of toilet 1 is seat 5. Mounted over seat 5 is toilet lid 6. At the rear area of the lid 6 is blower housing 11 which is integral with lid 6. Mounted to the rear of blower housing 11 is a blower intake duct 14. At the rear of the seat is an air channel 17. This channel is designed to be sufficiently wide to allow efficient evacuation of the air from the toilet bowl. Below toilet seat 5 at the rear of the toilet seat 5 is a load-bearing air channel extender 19. This may consist of a structure molded into the seat defining the sides of the air channel in the seat. This structure would also serve as load-bearing pad against the rim of toilet 1 for supporting the weight of the person sitting on the toilet seat.

Within blower housing 11 is blower 12. The illustrated embodiment is a motorized impeller which drives air through the system. At the back of blower intake duct 14 is an air vane 20. Air vane 20 may serve as a screen for debris.

Figure 3:
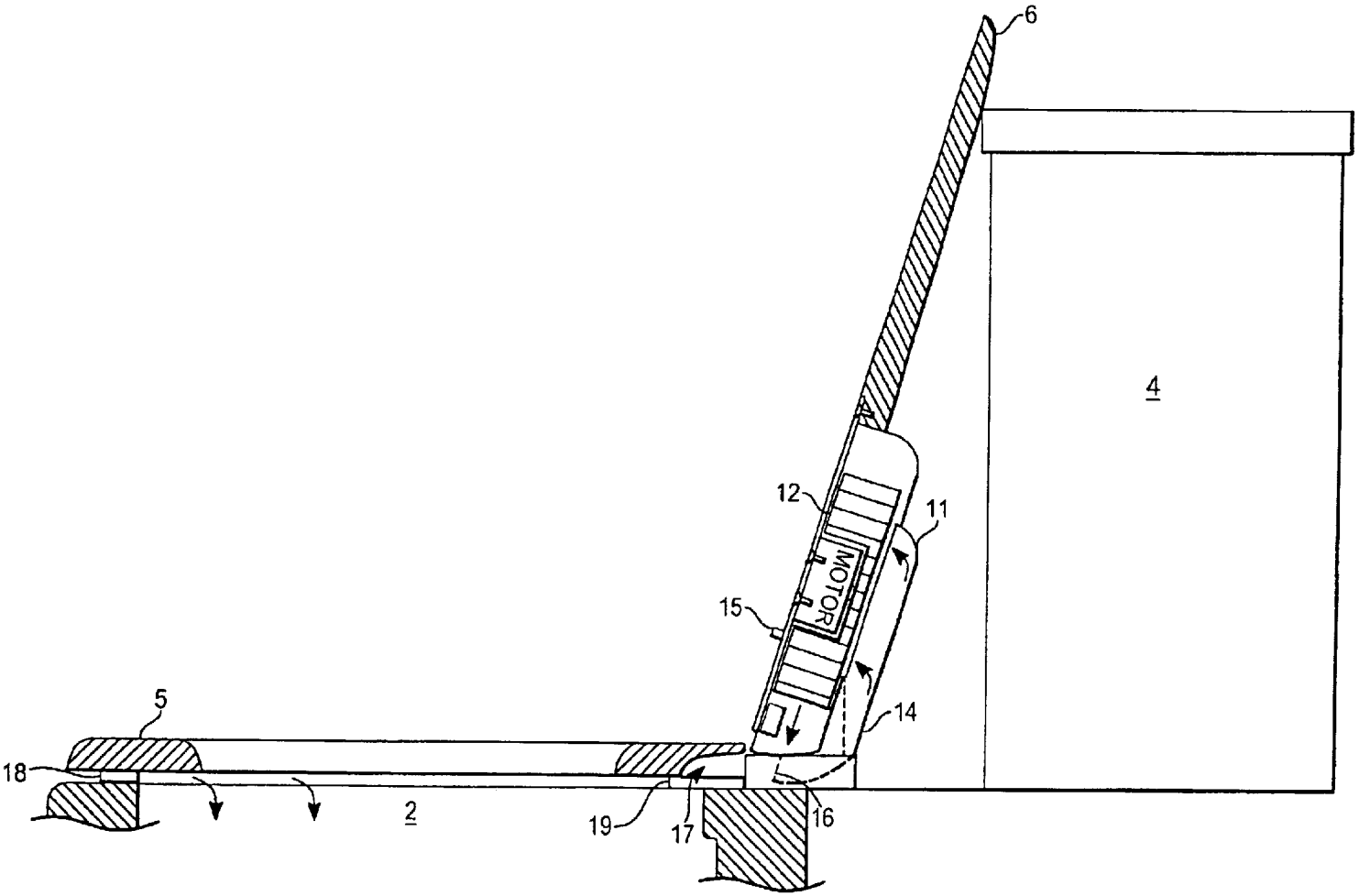
FIG. 3 is the lid seat and partial toilet bowl of FIG. 2 with the lid shown in a raised position.

The raising of the toilet lid activates the present ventilation system as well as creates the pathway for air travel into the device. In FIG. 3, lid 6 is shown raised and toilet seat 5 is shown lowered. Toilet seat 5 rests on load-bearing pads 18. The load-bearing pads are distributed along the toilet seat 5 on the underside of toilet seat 5 to distribute the weight of the person sitting on the toilet. These pads prevent the weight of the user from being transmitted to the hinge assembly. With the seat lowered the load bearing channel extender provides access into air channel 17.

When lid 6 is raised the air may flow from toilet bowl 2 through channel extender 19 into air channel 17 on the toilet seat 5 and into air intake passage 16 leading into blower intake duct 14. The arrows show the direction of air flow. Air may flow from the sides of the seat to replace the air evacuated from the toilet bowl 2.

Returning to FIG. 3, air drawn into air intake passage 16 goes into blower intake duct 14 within a space on the blower housing 11 above the blower 12. The air is then driven through the blower (shown by arrows) and vented (as will be shown in FIG. 4). When toilet lid 6 is raised against toilet tank 4 and toilet seat 5 is not raised, micro-switch 15 is activated. The micro-switch is depressed when the lid and seat are parallel such as when both lid and seat are down or when both lid and seat are up. When the switch is depressed the circuit is opened stopping the motor. Thus, the motor can only operate when the seat is down and the lid is up. This activation switch allows automatic activation of the device when the toilet is in use.

Figure 4A:
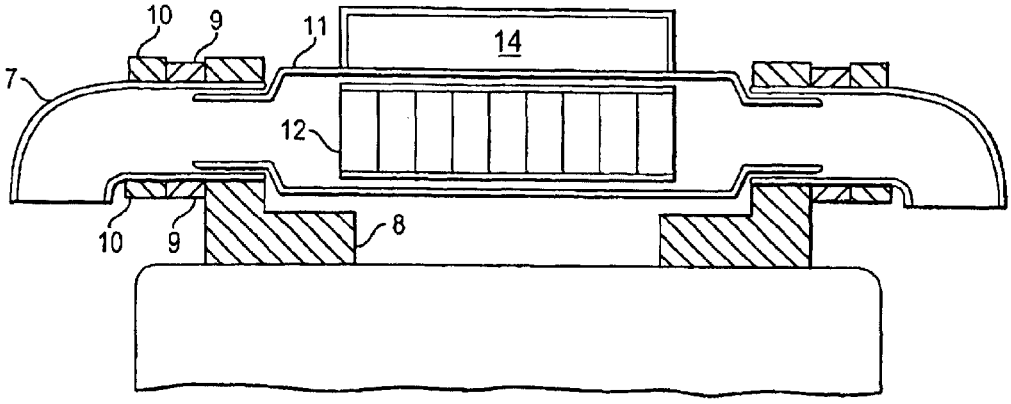
FIG. 4A is a cross sectional view along arrow B of FIG. 1.

With reference to FIG. 4A the side cut away of a portion of the device is shown. The air drawn through blower intake duct 14 is moved from the intake into a discharge tube which functions as an outflow duct. Mounting block 8 is mounted onto the porcelain mount at the back part of the toilet. This mounting block 8 includes a bore for mounting screw. The mounting block 8 is shaped to allow discharge tube 7 to be mounted on mounting block 8. The discharge tube 7 has a clamping device for a tight fit on mounting block 8. As discharge tube 7 is inserted in mounting block 8 the seat hinge 9 and lid hinge 10 may be slip fit over discharge tube 7. The lids would then open and close by rotating on discharge tube 7. The internal diameter of the cylindrical mounts on seat hinge 9 and lid hinge 10 are slightly larger than the external diameter of the discharge tube 7 to allow these hinges to slip fit over the discharge tube. Mounting block 8 acts as an air seal, sealing the connection of the outflow duct 7 to the interior space containing the fan. This ensures odors do not escape.

Figure 4B:
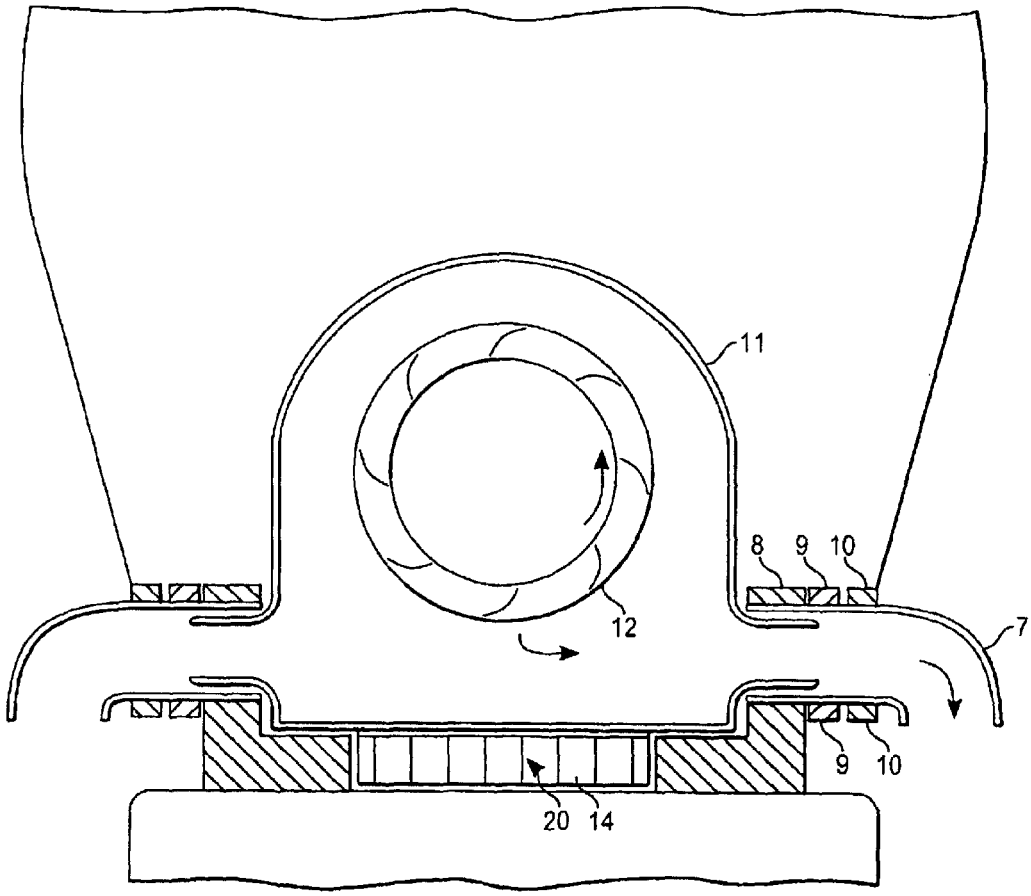
FIG. 4B is the cross sectional view of FIG. 4A when the toilet seat lid is raised.

Housing 11 is shaped such that air drawn by the fan within the interior defined by space 11 drawing air from duct 14 moves the air into discharge tube 7. With reference to FIG. 4 the cross section through the fan shows the drawing of air and movement of air as indicated by arrows through the fan into the space inside housing 11 to the side of the fan and into discharge tube 7. Air vanes 20 associated with blower intake 14 act as a screen for toilet paper or other objects from reaching the blower 12.

Figure 5:
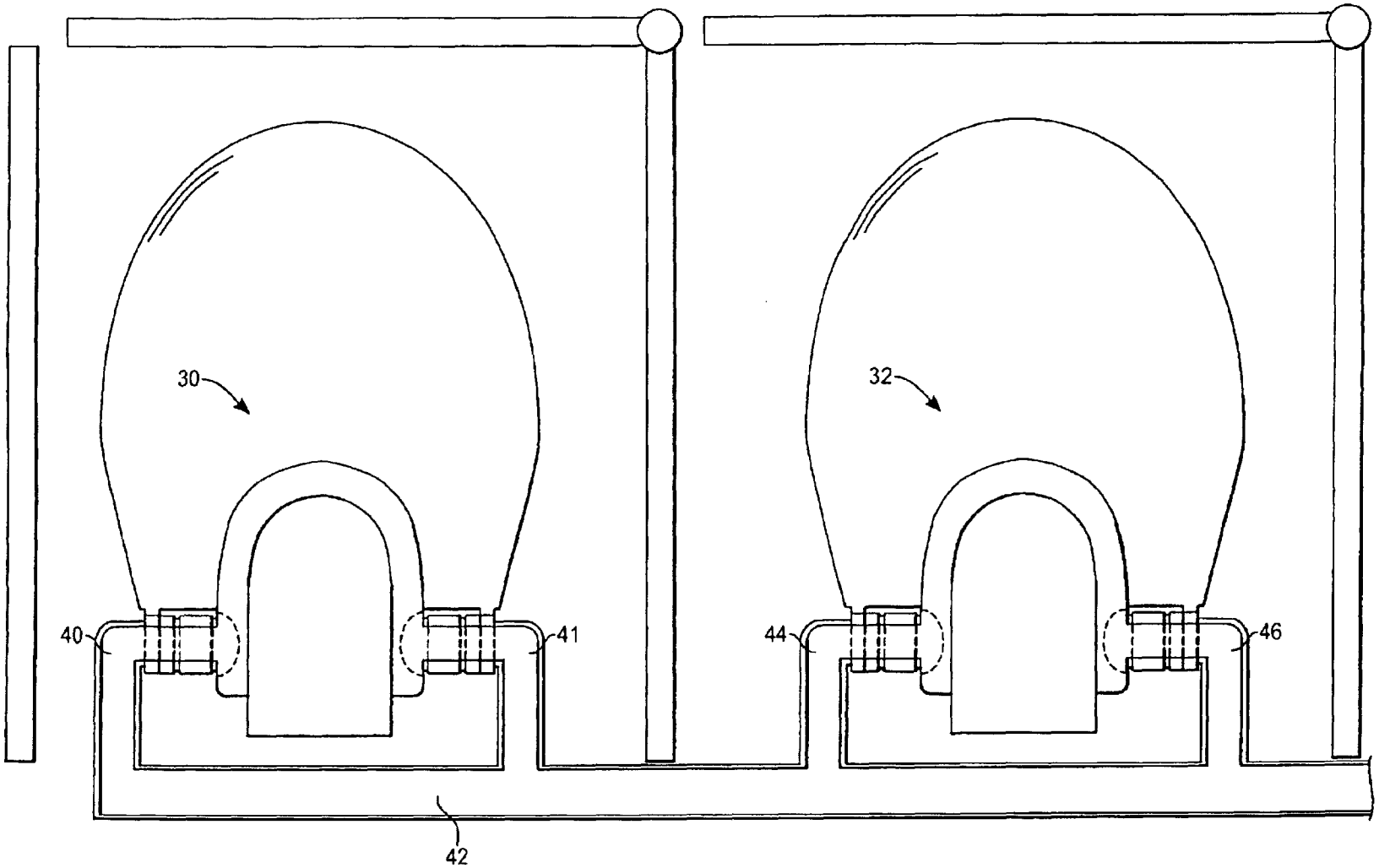
FIG. 5 is a top view of a plurality of toilets having venting ducts joined together.

With respect to FIG. 5, a plurality of toilets such as could be used in commercial establishment is shown. The two toilets 30 and 32 are each contained within respective individual stalls. Toilet 30 includes outflow ducts 40, 41 which are joined together and flow into outflow duct 42. The second toilet 32 has outflow ducts 44, 46 which are joined together and also flow into outflow duct 42. Outflow ducts 40, 41, 44, and 46 may include backflow dampers to prevent odors from escaping into neighboring stalls. Outflow duct 42 may be vented outside of the building or, if this is not possible may be driven through a filter or purifying to neutralize odors. This network of joined ducts provides efficient venting of the air moved by the devices.

The present seat assembly is configured to replace a standard toilet seat. Standard toilet seats generally have standardized attachment means. This generally is a pair of attachment bolt holes spaced at 5 and ⅝ inch centers. Bolts extend through the porcelain toilet and through the bolt holes of the toilet seat mounting block allowing the seat to be securely anchored. The present device a user may avoid having to replace the entire porcelain toilet as is required in a number of prior ventilation devices. Using currently available lids and seats when the toilet lid and seat are raised they rest at an angle against the toilet tanks such that the lid and seat remain open after they are raised. This would also be true using the present invention. The seat hinge may be offset forward to allow for this positioning.

The standard toilet seat has no concealed or inaccessible spaces or surface. This is necessary to allow for cleaning of the toilet and seat assembly. The toilet seat of the present invention is intended to be similar to the standard seat with regard to hygiene. When only the lid is raised a sealed air chamber is created between the lid and seat. This chamber acts as an intake duct from the toilet bowl. When the seat is also raised the geometry changes and there is no longer an air chamber. At such time all surfaces are accessible to be cleaned.

The present device could be made out of molded plastic in a variety of colors and styles similar to present toilet seats.

The blower preferably meets certain requirements to be suitable for use in this application. The air flow quantity and pressure should be such that the negative air pressure is maintained within the toilet bowl without creating an undue vacuum pressure which would be felt by the user of the toilet. One contemplated embodiment uses a blower rated as 10 cubic feet per minute at 0.3 inch static pressure. Preferably the fan which is used is a motorized impeller having a blower wheel of a self-cleaning type that does not plug with lint. One possible embodiment is a self-cleaning backward-incline blower wheel. Another possible blower is a radial air exhaust impeller. The blower wheel may be made of fiber glass reinforced plastic mounted on bearings on a reinforced steel plate. Electrical connection would be from dual leads. It is preferred that the blower assembly be of non-corroding materials such as plastic. This would allow longest life in the moist environment expected in its present use. It is preferred that the motor be relatively quiet so that it is able to operate relatively unobtrusively. A large diameter, narrow width blower wheel is able to operate at relatively slow RPM and thereby operate quietly and efficiently. The ample size and smooth transitions of the air passages also assures quiet, efficient fan operation. Such efficient fan operation allow for low power consumption to permit extended battery operation. A low voltage motor is preferred. This reduces the chance of electrical shock. One contemplated embodiment uses a 12 volt direct current motor. The contemplated embodiment would use only 5 watts allowing long life under battery operation. Such battery operation could use a rechargeable battery pack or disposable batteries.

It is envisioned that the present device could simply be plugged into a nearby 120 volt power outlet using a 12 volt DC transformer. The transformer would plug into the outlet and a cord would extend into a sealed gasket through the discharge tube to the fan motor.

Given that many restrooms do not have outlets in close proximity to the toilet, there could also be a battery powered embodiment of the present invention. This could use the same 12 volt direct current motor to power the impeller, fan, or blower. For example, a 12 volt battery pack using NiMH batteries would have a storage capacity of 4,000 micro-amp hours. Since the motor draws approximately 0.4 amps this provides a theoretical battery life of 10 hours continuous use. Since actual use may only be a few minutes per day, the battery recharge interval might be several weeks.

The activation switch may be a micro-switch activated when the lid is raised and the seat is no longer pressing against the switch. Alternatively any other similar type of activation switch may be employed.

A potentiometer may be used as a blower speed control. Alternatively variable speed fans or blowers or other fan means may be used. A time delay may also be added. The time delay will allow the blower to run for a certain length of time after the blower is started. This should be useful if the lid is left up with the seat left down. The blower would automatically turn off after a period of time (15 minutes for example). Switching the system off by lowering the lid and back on by raising the lid would reset the timer, reactivating the blower. Manual activation of the micro switch would also reset the timer. All of this circuitry would be part of switch 15 shown in FIG. 3. Thus switch 15 in FIG. 3 could be a timer, time delay, or manual switch. Alternatively, a separate circuit board could be added.

In the present illustrations, the embodiments include dual exhaust pipes on both sides of the device. It is possible that a single side exhaust could be used. The alternate side would be sealed. However, dual exhaust systems could provide better blower performance.

Figure 6:
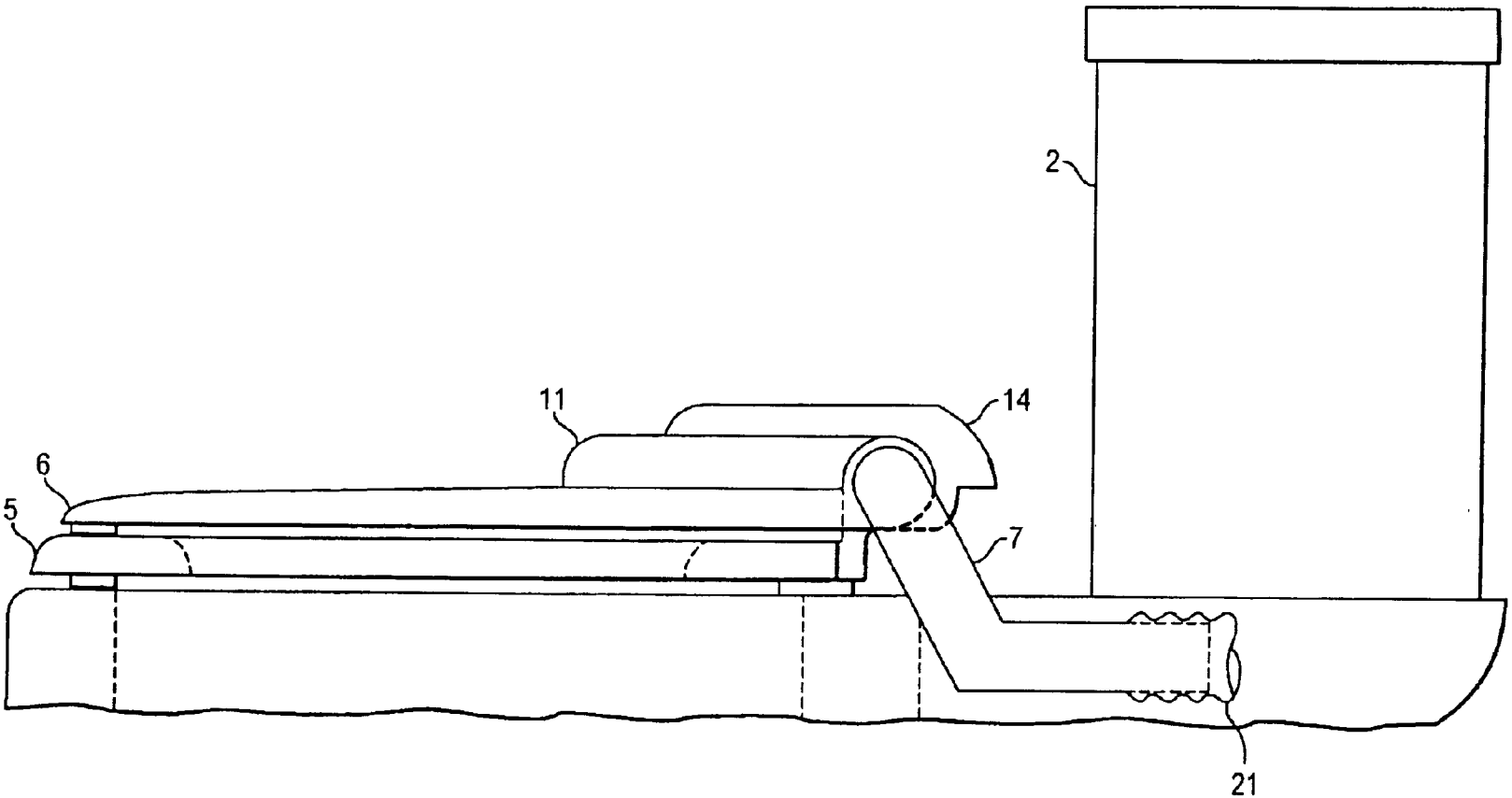
FIG. 6 is a side view of the seat assembly installed on the toilet.

FIG. 6 shows the discharge tubes 7 extending to a location below the toilet tank. Since the discharge tubes will be visible they may be chrome plated for aesthetic considerations. A flexible hose 21 may be connected to the discharge tube 7. The flexible hose would be hidden by the tank. The hoses could terminate a number of locations that include venting through a wall, venting into a wall cavity, venting into an attic or crawl space, using a extension pipe, venting through the roof, or discharging through a charcoal filter or other odor removal device inside a restroom. Venting through the nearest wall is preferred in that it requires the least amount of duct material. A standard dryer vent wall cap could be used for the terminal of the vent. An adapter would be used to connect the seat assembly hoses to the dryer vent.

Alternatively, the duct could be positioned along the existing plumbing for the toilet running through the wall cavity and exiting into a basement or ceiling area.

Another alternative is to vent using a spring-pole type device. This device is shown in U.S. Pat. No. 6,202,226 hereby incorporated by reference herein. This assembly uses a spring-loaded pole installed proximate to the toilet. The hose would connect to the pole and the pole acts as a duct to carry exhaust from the room. In new construction, the best approach could be to add a 2 inch vent pipe to the roof. This could be installed next to the sanitary sewer vent pipe. The vent line would require a rain cap at the roof to prevent rain from entering the pipe.

What is claimed is:

1. A device for removal of toilet bowl odors comprising:

a toilet seat lid having an interior space;

a fan within said interior space;

an intake passage through which said fan draws air, said intake passage located on said toilet seat lid to withdraw air from the toilet bowl when the toilet seat is raised;

one or more outflow ducts forming a hinge for the toilet seat lid and toilet seat, said outflow ducts jointed to the intake passage and the interior space such that air drawn from the toilet bowl by the fan is driven into the outflow ducts, said outflow ducts extending to a location remote from the toilet part of said ducts;

an air seal sealing a connection of said outflow ducts to said interior space; and an activation switch that may be actuated to activate the fan.

2. The device of claim 1, further including a time delay for the fan.

3. The device of claim 1, wherein the outflow ducts are linked into a network of outflow ducts from a plurality of toilets.

4. The device of claim 1, wherein the intake duct is removable.

5. A method of removing odors from a toilet comprising:

a) raising a toilet lid while not raising a toilet seat, wherein said toilet seat and lid are configured such that raising the toilet lid both activates a blower and opens a conduit to the blower;

b) continuously evacuating air from the toilet bowl using a fan in the toilet lid while the lid is raised; and c) continuously venting evacuated air to a remote location while the lid is raised.

6. The method of claim 5, wherein the remote location is outside of the building the toilet is located in.

7. The method of claim 5, wherein the remote location is on the roof.

8. The method of claim 5, wherein the remote location is into a wall cavity.

9. The method of claim 5, wherein steps b and c occur for a preset timed period.

10. The method of claim 9, wherein the timed period may be reset by closing and reopening the toilet lid.

11. The method of claim 9, wherein the timed period may be reset by manual activation of the micro-switch.

* * * * *